US009259046B2

(12) United States Patent
Lee

(10) Patent No.: US 9,259,046 B2
(45) Date of Patent: Feb. 16, 2016

(54) COMBINATION HAT AND EARPHONE ASSEMBLY

(71) Applicant: SOUND TEAM ENTERPRISE CO., LTD., Taipei (TW)

(72) Inventor: Lee-Fong Lee, Taipei (TW)

(73) Assignee: SOUND TEAM ENTERPRISE CO., LTD., Taipei (TW)

( * ) Notice: Subject to any disclaimer, the term of this patent is extended or adjusted under 35 U.S.C. 154(b) by 538 days.

(21) Appl. No.: 13/714,210

(22) Filed: Dec. 13, 2012

(65) Prior Publication Data

US 2014/0047616 A1 Feb. 20, 2014

(30) Foreign Application Priority Data

Aug. 16, 2012 (TW) ..... 101215820 U

(51) Int. Cl.
*H04R 25/00* (2006.01)
*A42B 1/24* (2006.01)

(52) U.S. Cl.
CPC ..... *A42B 1/245* (2013.01); *H04R 25/00* (2013.01)

(58) Field of Classification Search
CPC ..... H04R 1/1058; H04R 2201/107; H04R 1/1008
USPC ..... 381/375, 376, 187, 25, 183; 379/430; 455/351, 575.2; 2/195, 195.2, 200.1, 2/209.13, 244, 209.3, 209
See application file for complete search history.

(56) References Cited

U.S. PATENT DOCUMENTS 5,881,390 A * 3/1999 Young ..... A41D 20/00 2/209.13
2001/0016958 A1* 8/2001 Linday ..... 2/10
2009/0175482 A1* 7/2009 Crutcher ..... 381/376

* cited by examiner

*Primary Examiner* — Brian Ensey
*Assistant Examiner* — Julie X Dang
(74) *Attorney, Agent, or Firm* — Muncy, Geissler, Olds & Lowe PC

(57) ABSTRACT

A combination hat and earphone assembly includes beanie hat having two storage pockets bilaterally located a brim part thereof and two loops spaced between the storage pockets at different elevations, and an earphone set including two earphone speakers respectively accommodated in the storage pockets, an electrical adapter having two wing strips respectively inserted through the two loops to hold the electrical adapter in a horizontal position, and a transmission cable inserted through a through hole on the brim part of the beanie hat to electrically connect the electrical adapter to an external mobile sound source for audio input.

5 Claims, 4 Drawing Sheets

COMBINATION HAT AND EARPHONE ASSEMBLY

This application claims the priority benefit of Taiwan patent application number 101215820, filed on Aug. 16, 2012.

BACKGROUND OF THE INVENTION

1. Field of the Invention

The present invention relates to an earphone set attached hat and more particularly, to a combination hat and earphone assembly, which includes a beanie hat providing two storage pockets located at the brim part thereof corresponding to the user's ears, and an earphone set having two earphone speakers thereof respectively accommodated in the storage pockets of the beanie hat and a transmission cable thereof inserted through a through hole on the beanie hat and electrically connectable to an external mobile sound source for audio input.

2. Description of the Related Art

Following fast development of electronic technology, smart phones, tablet computers, mini notebooks, ultrabooks and many other small mobile electronic devices with expanded functions have been created to serve people. For the advantages of communication, dialogue, camera, video camera, internet, game, on-line game, navigation, music play and/or many other functions, these mobile electronic devices have become a requisite in many people's daily life. Through a mobile electronic device, the user can download music from the internet for direct play. However, directly outputting a music song from the speaker of a mobile electronic device will disturb surrounding people, and the user may be unable to hear the music song well. Therefore, people usually attach an earphone set to the ears to listen to music from a mobile music player or any other mobile electronic device. When one is resting, walking, riding a bicycle or motorcycle, or waiting for a bus, one may listen to a music outputted from a mobile music player by means of an earphone set or headphone set. However, wearing an earphone set or headphone set outdoor in winter season may hinder the wear of a hat. After wearing a hat to keep the head warm, it will be difficult or unstable to put an earphone set or headphone set on the ears. In actual practice, people may encounter the following problems.

1. The earphone set/headphone set or the hat occupies a certain space, the hat or earphone set/headphone set may fall from the head when they both are put together on the head, and the user can simply select the hat or the earphone set/headphone set to be worn on the head.
2. The earphone set/headphone set and the hat are two separated items. Carrying these two items require much space. Further, the electrical wires of the earphone set/headphone set may be tangled, and the speakers may be damaged accidentally by an impact.

Therefore, it is desirable to find a measure that allows people to wear an earphone set and a hat conveniently and comfortably at the same time without causing any interference.

SUMMARY OF THE INVENTION

The present invention has been accomplished under the circumstances in view. It is therefore the main object of the present invention to provide a combination hat and earphone assembly, which allows people to wear an earphone set and a beanie hat conveniently and comfortably at the same time without causing any interference.

To achieve this and other object of the present invention, a combination hat and earphone assembly comprises a beanie hat and an earphone set. The beanie hat comprises a bucket part defining therein a head-receiving space for enabling the beanie hat to be positioned on the user's head, and a brim part extending outwardly in a direction away from the bucket part and divided into a plurality of regions disposed at different elevations that can be folded up into a multilayer brim. The brim part comprises two storage pockets bilaterally located at the topmost region thereof and horizontally arranged facing each other at roughly 180 degrees, two loops located at the topmost region at different elevations and equally spaced between the two storage pockets, and a through hole cut through the same region and disposed between the loops and one storage pocket. Further, each storage pocket defines a flexible storage chamber, and an opening at a part of the left or right side thereof. Further, the earphone set comprises two earphone speakers respectively accommodated in the storage pockets of the beanie hat, an electrical adapter, which comprises an two positioning wing strips extended from the periphery thereof in reversed directions and respectively inserted into the two loops of the beanie hat, two electrical wires electrically connecting the two earphone speakers to the electrical adapter, and a transmission cable adapted to electrically connect the two earphone speakers to an external mobile sound source for electronic signal input. The transmission cable comprises a first audio plug located at one end thereof and detachably electrically connectable to the electrical adapter, and a second audio plug located at an opposite end thereof and electrically connectable to an audio jack of a mobile electronic device. Because the positioning wing strips of the electrical adapter are respectively inserted through the two loops of the beanie hat to have the electrical adapter with the attached first audio plug of the transmission cable be held in a horizontal position between the two loops of the foldable brim part of the beanie hat, the arrangement of the earphone set in the beanie hat does not cause any form of discomfort.

Further, the first audio plug of the transmission cable of the earphone set comprises a plurality of waterproof ribs extending around the periphery of an electrically insulative enclosure thereof. After insertion of the first audio plug into the plug hole of the electrical adapter, the waterproof ribs are squeezed by and tightly stopped against the inner perimeter of the plug hole to prohibit outside rainwater or moisture from entering the plug hole of the electrical adapter, ensuring a high level of signal transmission quality.

DETAILED DESCRIPTION OF THE PREFERRED EMBODIMENT

Figure 1:
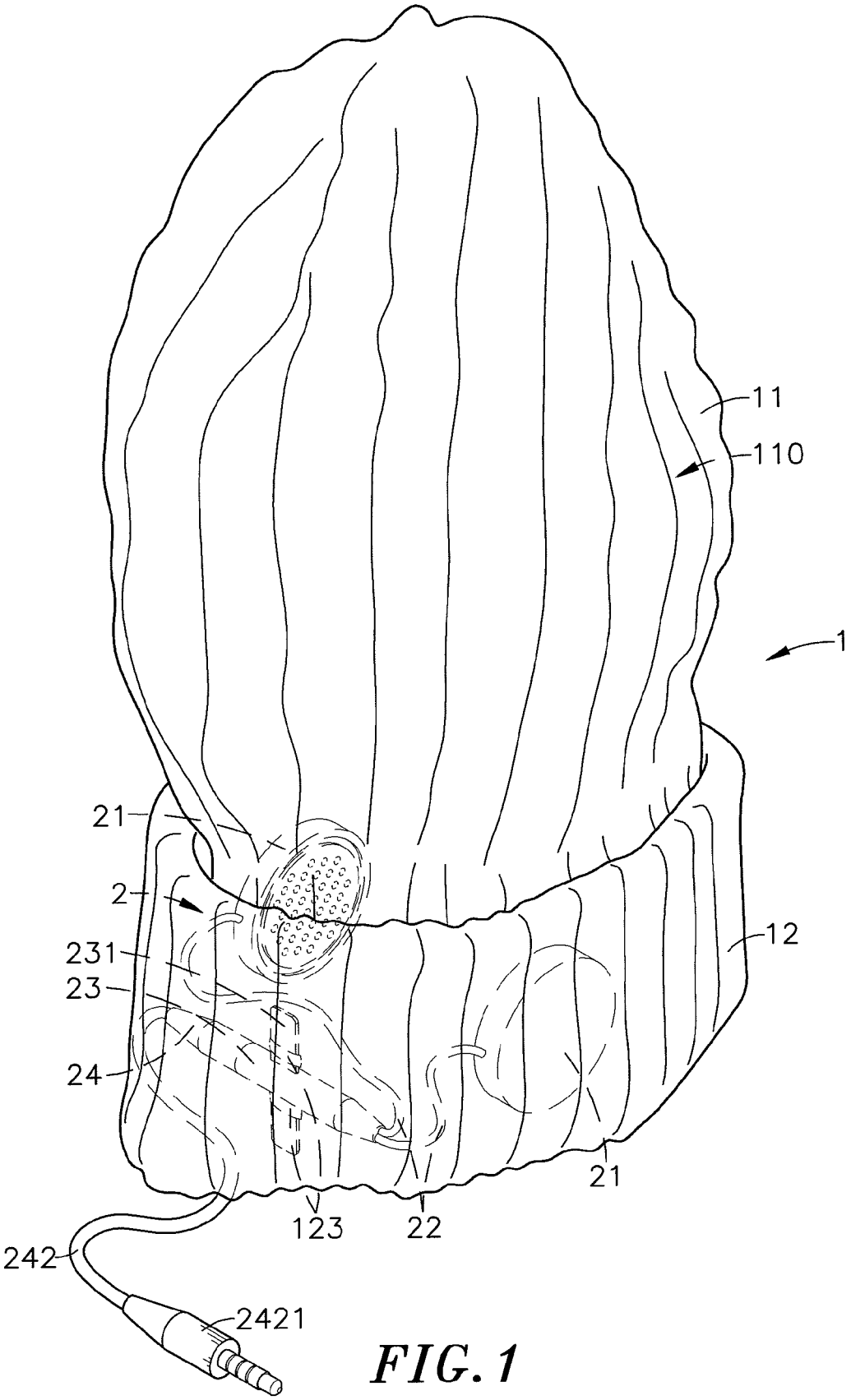
FIG. 1 is a schematic drawing illustrating a combination hat and earphone assembly in accordance with the present invention.
Figure 2:
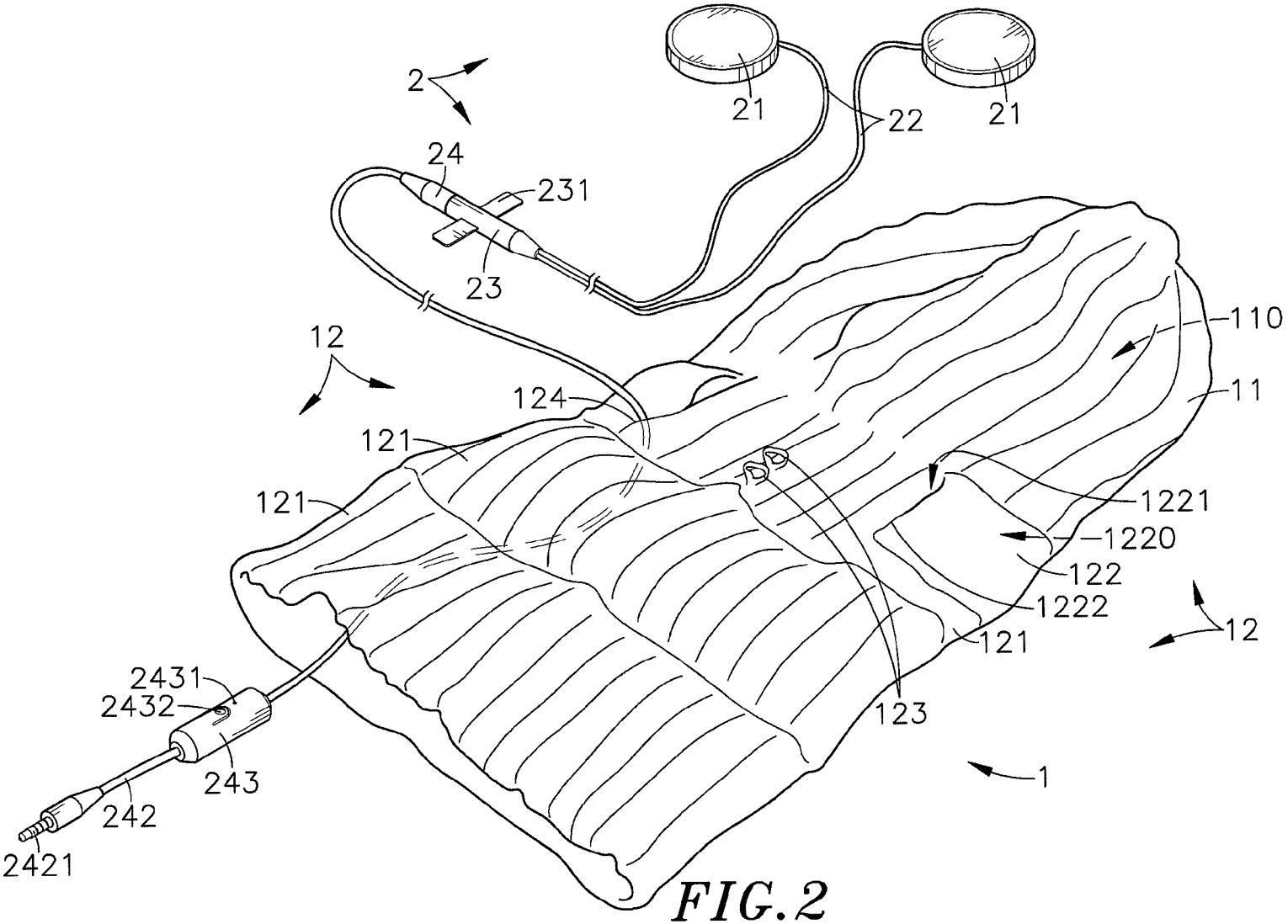
FIG. 2 corresponds to FIG. 1, illustrating the earphone speakers moved to the outside of the beanie hat.
Figure 3:
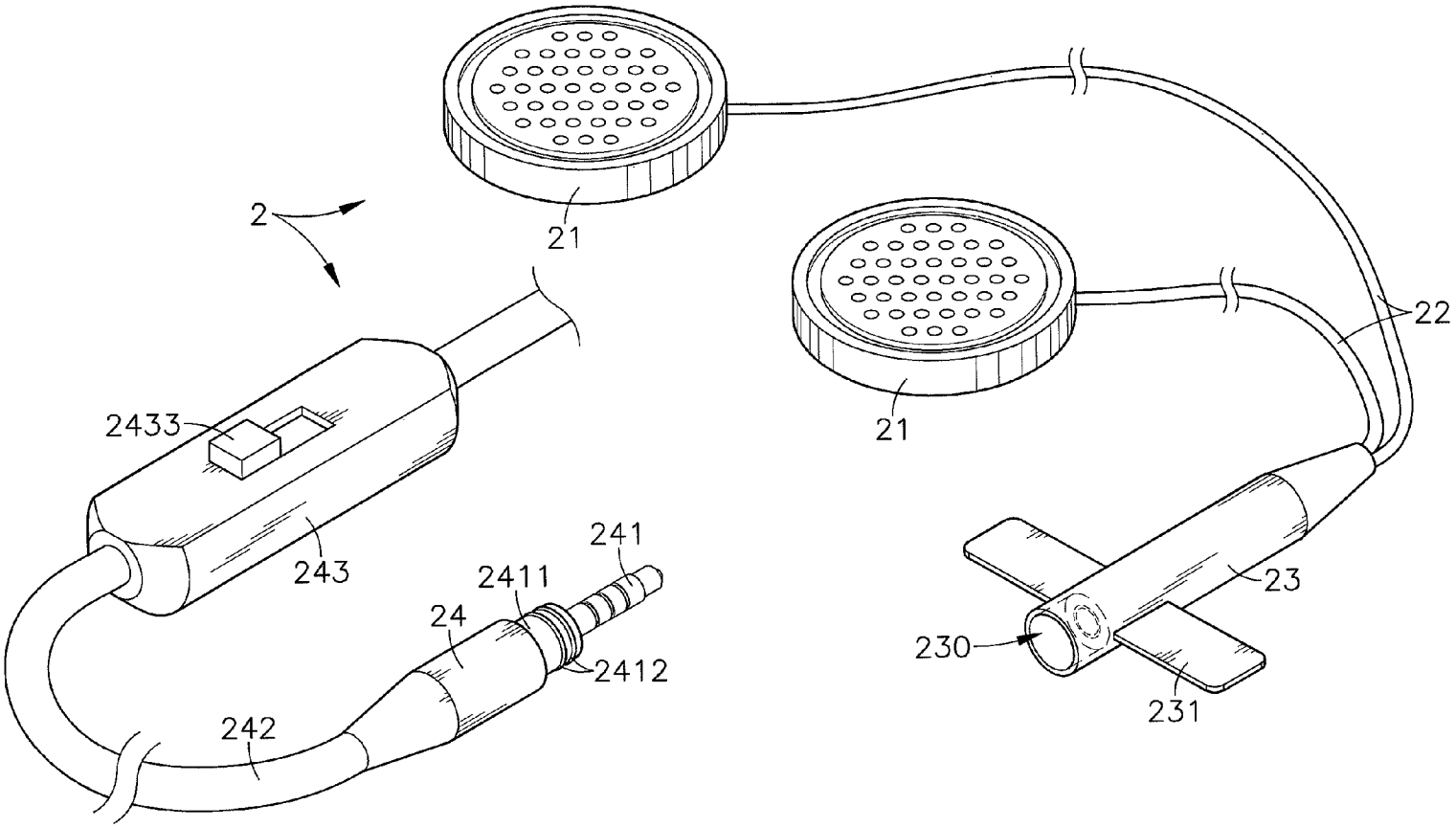
FIG. 3 is an exploded view of the earphone set in accordance with the present invention.

Referring to FIGS. 1-3, a combination hat and earphone assembly in accordance with the present invention is shown comprising a beanie hat 1 and an earphone set 2.

The beanie hat 1 comprises a bucket part 11 defining therein a head-receiving space 110 for enabling the beanie hat to be positioned on the user's head, and a brim part 12 extending outwardly in a direction away from the bucket part 11. The brim part 12 is divided into a plurality of regions 121 disposed at different elevations. These regions 121 can be folded up into a multilayer brim. Further, the brim part 12 comprises two storage pockets 122 bilaterally located at one region 121, preferably at the topmost region, and horizontally arranged facing each other at roughly 180 degrees. Each storage pocket 122 defines a flexible storage chamber 1220 and an opening 1221 at a left or right side thereof. The left or right side of each storage pocket 122 where the opening 1221 is located is partially sealed, i.e., the left or right side of each storage pocket 122 has one part forming the opening 1221 and the other part forming an enclosed portion 1222. The brim part 12 further comprises two loops 123 located at the same region 121 at different elevations and equally spaced between the two storage pockets 122, and a through hole 124 cut through the same region 121 in communication between the head-receiving space 110 and the surrounding and disposed between the loops 123 and one storage pocket 122.

The earphone set 2 comprises two earphone speakers 21 for converting an electronic signal into a sound wave for output into the ear canals of the user, an electrical adapter 23, which comprises an axially extending plug hole 230 and two positioning wing strips 231 extended from the periphery thereof in reversed directions, two electrical wires 22 electrically connecting the two earphone speakers 21 to the electrical adapter 23, and a transmission cable 24 adapted to electrically connect the two earphone speakers 21 to an external mobile sound source for electronic signal input. The transmission cable 24 comprises a first audio connector, for example, first audio plug 241 electrically connectable to the plug hole 230 of the electrical adapter 23, and a second audio connector, for example, second audio plug 2421 electrically connectable to an audio jack of an external mobile sound source (not shown), and an electrical cable 242 connected between the first audio plug 241 and the second audio plug 2421. Further, the plug hole 230 has a certain depth for receiving the first audio plug 241 of the transmission cable 24.

During installation, insert the two earphone speakers 21 of the earphone set 2 through the openings 1221 of the storage pockets 122 of the beanie hat 1 into the respective flexible storage chambers 1220, and then insert the positioning wing strips 231 of the electrical adapter 23 through the two loops 123 of the beanie hat 1 to position the electrical adapter 23 in a horizontal position between the two loops 123, and then insert the first audio plug 241 of the transmission cable 24 through the through hole 124 of the beanie hat 1 and plug the first audio plug 241 into the plug hole 230 of the electrical adapter 23, and then plug the second audio plug 2421 into an audio jack of an external mobile sound source (MP3, MP4, MP5, cell phone, smart phone, notebook, or tablet PC). After installation, the positioning of the earphone set 2 in the beanie hat 1 does not hinder the user from wearing the beanie hat 1 or folding up/extending out the brim part 12.

As stated above, each storage pocket 122 of the beanie hat 1 defines a flexible storage chamber 1220 and an opening 1221 at the left or right side thereof; the left or right side of each storage pocket 122 where the opening 1221 is located is partially sealed, i.e., the left or right side of each storage pocket 122 has one part forming the opening 1221 and the other part forming an enclosed portion 1222. Thus, after insertion of the two earphone speakers 21 of the earphone set 2 through the openings 1221 of the storage pockets 122 of the beanie hat 1 into the respective flexible storage chambers 1220, the enclosed portions 1222 of the storage pockets 122 keep the respective earphone speakers 21 positively in the respective flexible storage chambers 1220, preventing the earphone speakers 21 from falling out of the storage pockets 122 when the user is walking. Further, the first audio plug 241 comprises a plurality of waterproof ribs 2412 extending around the periphery of an electrically insulative enclosure 2411 thereof. After insertion of the first audio plug 241 into the plug hole 230 of the electrical adapter 23, the waterproof ribs 2412 are squeezed by and tightly stopped against the inner perimeter of the plug hole 230 to prohibit outside rainwater or moisture from entering the plug hole 230 of the electrical adapter 23, ensuring a high level of signal transmission quality. The transmission cable 24 further comprises a volume control 243 installed in the electrical, cable 242. The volume control 243 comprises a volume control lever handle 2433 for regulating sound level, a mini microphone 2431 for converting an external sound wave into an electronic signal and then transmitting the electronic signal through the electrical cable 242, the first audio plug 241, the electrical adapter 23 and the electrical wires 22 to the earphone speakers 21, and a microphone on/off switch 2432 operable to switch on/off the mini microphone 2431.

Further, as an alternate form of the present invention, the first audio connector 241 of the transmission cable 24 can be made in the form of a female electrical connector (audio jack), and the electrical adapter 23 can be made in the form of a male electrical connector (electrical plug) for the connection of the female electrical connector (audio jack) type of first audio connector 241 of the transmission cable 24.

Figure 4:
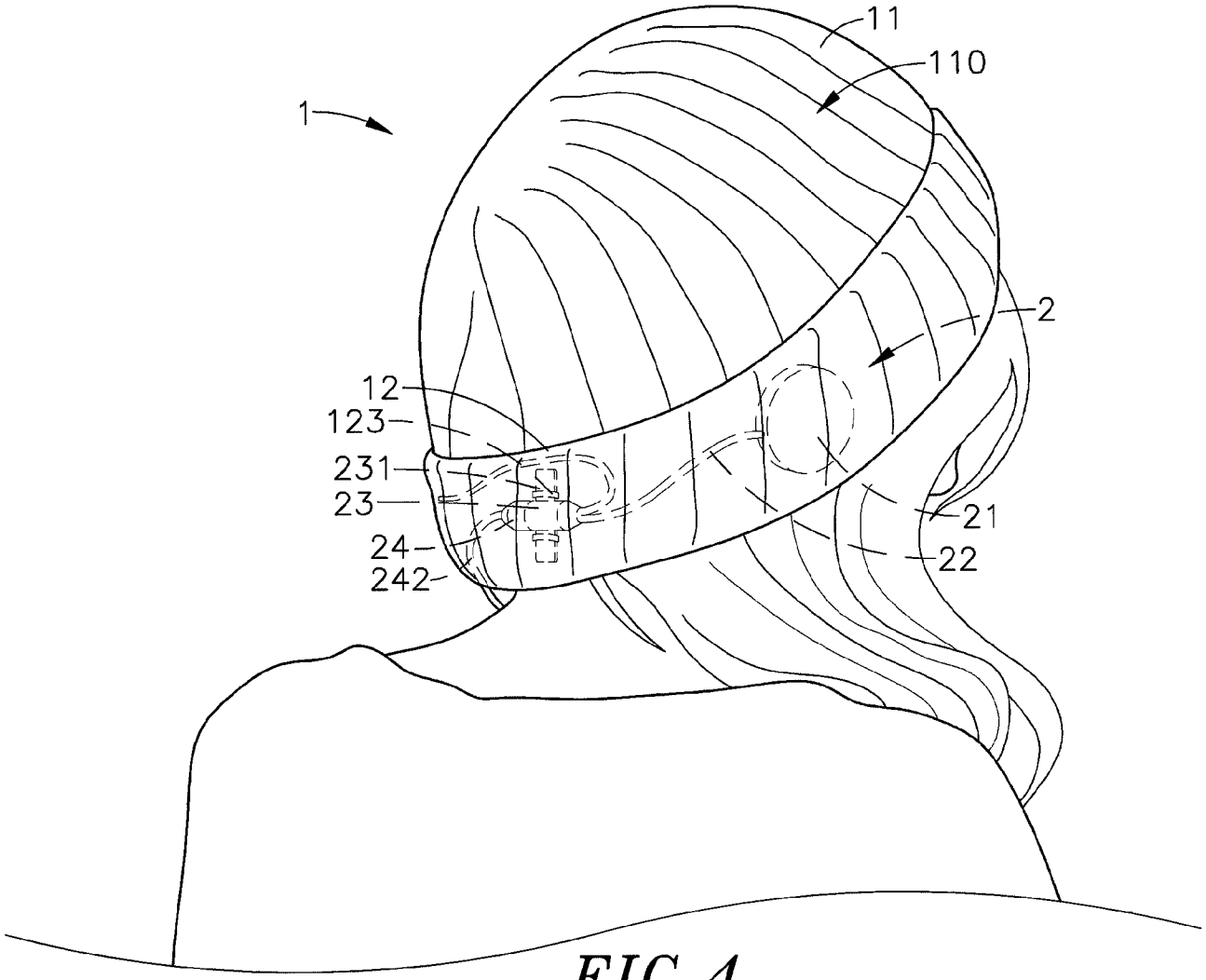
FIG. 4 is a schematic applied view of the present invention, illustrating the combination hat and earphone assembly worn on the user's head.

Referring to FIG. 4 and FIGS. 1-3 again, after the beanie hat 1 and the earphone set 2 are assembled, the user can wear the earphone set 2 on the head to hold the two earphone speakers 21 in proximity to the ears, and then connect the second audio plug 2421 of the transmission cable 24 of the earphone set 2 to the audio jack of the mobile sound source (MP3, MP4, MP5, cell phone, smart phone, notebook, or tablet PC) being carried by the user. At this time, the user can listen to music from the mobile sound source. Because the electrical adapter 23 and the first audio connector 241 of the transmission cable 24 are kept in the folded brim part 12 of the beanie hat 1, carrying the earphone set 2 in the beanie hat 1 on the head does not cause any form of discomfort. No interference can occur between the beanie hat 1 and the earphone set 2. At this time, the beanie hat 1 can keep the user's head warm, avoiding the earphone speakers 21 from completely blocking the user's ears and allowing the user to hear outside sound while listening to music from the earphone speakers 21. Thus, using the combination hat and earphone assembly is comfortable and safe. Further, because the earphone set 2 can be positioned in the brim part 12 of the beanie hat 1, the user can carry the earphone set 2 conveniently, and the earphone speakers 21 of the earphone set 2 are well protected in the beanie hat 1, avoiding getting lost or accidental damage. Further, when the user puts the beanie hat 1 on the head, the earphone speakers 21 of the earphone set 2 are automatically hold in proximity to the user's ears for enabling the user to listen to music from the earphone speakers 21. Further, the user can conveniently detach the earphone set 2 from the beanie hat 1, allowing the beanie hat 1 to be washed. After the beanie hat 1 is well cleaned, the earphone set 2 can be installed in the beanie hat 1 again.

As stated above, when installing the earphone set 2 in the beanie hat 1, the positioning wing strips 231 of the electrical adapter 23 are respectively inserted through the two loops 123 of the beanie hat 1 to have the electrical adapter 23 be held in a horizontal position between the two loops 123, and then the first audio plug 241 of the transmission cable 24 is inserted through the through hole 124 of the beanie hat 1 and plugged into the plug hole 230 of the electrical adapter 23. Because the electrical adapter 23 and the first audio plug 241 of the transmission cable 24 are kept in the folded brim part 12 of the beanie hat 1 in a horizontal position at the back side of the user's head around the neck, the arrangement of the earphone set 2 in the beanie hat 1 does not hinder in anyway the motion of the user, i.e., the user wearing the combination hat and earphone assembly can turn the head and the neck freely without causing any form of discomfort. Further, the electrical adapter 23 and the first audio plug 241 of the transmission cable 24 can be male or female audio connector that mate with each other.

It is to be understood that the embodiment described above is simply an example of the present invention but not intended as limitations. In general, the invention provides a combination hat and earphone assembly, which comprises a beanie hat 1 and an earphone set 2. The beanie hat 1 comprises a bucket part 11 defining therein a head-receiving space 110 for enabling the beanie hat to be positioned on the user's head, and a brim part 12 extending outwardly in a direction away from the bucket part 11 and divided into a plurality of regions 121 disposed at different elevations that can be folded up into a multilayer brim. The brim part 12 comprises two storage pockets 122 bilaterally located at the topmost region 121 thereof and horizontally arranged facing each other at roughly 180 degrees, two loops 123 located at the topmost region 121 at different elevations and equally spaced between the two storage pockets 122, and a through hole 124 cut through the same region 121 and disposed between the loops 123 and one storage pocket 122. Further, each storage pocket 122 defines a flexible storage chamber 1220, and an opening 1221 at a part of the left or right side thereof. Further, the earphone set 2 comprises two earphone speakers 21 respectively accommodated in the storage pockets 122 of the beanie hat 1, an electrical adapter 23, which comprises an two positioning wing strips 231 extended from the periphery thereof in reversed directions and respectively inserted into the two loops of the beanie hat 1, two electrical wires 22 electrically connecting the two earphone speakers 21 to the electrical adapter 23, and a transmission cable 24 adapted to electrically connect the two earphone speakers 21 to an external mobile sound source for electronic signal input.

In general, the invention provides a combination hat and earphone assembly, which has the advantages and features as follows:

1. The positioning wing strips 231 of the electrical adapter 23 are respectively inserted through the two loops 123 of the beanie hat 1 to have the electrical adapter 23 with the attached first audio plug 241 of the transmission cable 24 be held in a horizontal position between the two loops 123 of the foldable brim part 12 of the beanie hat 1, and therefore the arrangement of the earphone set 2 in the beanie hat 1 does not cause any form of discomfort.
2. The left or right side of each storage pocket 122 of the brim part 12 of the beanie hat 1 has one part forming an opening 1221 and the other part forming an enclosed portion 1222, and thus, the two earphone speakers 21 of the earphone set 2 can be accommodated in the respective storage pockets 122 and positively held in place by the respective enclosed portion 1222.
3. The transmission cable 24 of the earphone set 2 is inserted through the through hole 124 of the beanie hat 1 and electrically connected to an external mobile sound source (MP3, MP4, MP5, cell phone, smart phone, notebook, or tablet PC), and the user can operate the volume control 243 of the transmission cable 24 to regulate the sound level.
4. The first audio plug 241 comprises a plurality of waterproof ribs 2412 extending around the periphery of the electrically insulative enclosure 2411 thereof. After insertion of the first audio plug 241 into the plug hole 230 of the electrical adapter 23, the waterproof ribs 2412 are squeezed by and tightly stopped against the inner perimeter of the plug hole 230 to prohibit outside rainwater or moisture from entering the plug hole 230 of the electrical adapter 23, ensuring a high level of signal transmission quality.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A combination hat and earphone assembly, comprising:

a beanie hat comprising a bucket part defining therein a head-receiving space for enabling said beanie hat to be positioned on the user's head, and a brim part extending outwardly in a direction away from said bucket part, said brim part comprising two storage pockets bilaterally and horizontally arranged facing each other at roughly 180 degrees, two loops disposed at different elevations between said two storage pockets, and a through hole disposed between said loops and one said storage pocket; and an earphone set comprising two earphone speakers respectively accommodated in said storage pockets of said beanie hat, an electrical adapter, said electrical adapter comprising a two positioning wing strips extended from the periphery thereof in reversed directions and respectively inserted into said two loops of said beanie hat to hold said electrical adapter at said brim part of said beanie hat in a horizontal position, two electrical wires electrically connecting said two earphone speakers to said electrical adapter, and a transmission cable insertable through said through hole of said beanie hat to electrically connect said electrical adapter to an external mobile sound source for allowing transmission of electronic signals from said external mobile sound source to said earphone speakers, said transmission cable comprising a first audio connector located at one end thereof and electrically connectable to said electrical adapter and a second audio connector located at an opposite end thereof and electrically connectable to an external mobile sound source.

2. The combination hat and earphone assembly as claimed in claim 1, wherein said brim part is divided into a plurality of regions disposed at different elevations, said regions being foldable into a multilayer brim; said two storage pockets and said two loops and said through hole are located at one said region.

3. The combination hat and earphone assembly as claimed in claim 1, wherein each said storage pocket defines therein a flexible storage chamber, and one lateral side of each said storage pocket has one part forming an opening and the other part forming an enclosed portion.

4. The combination hat and earphone assembly as claimed in claim 1, wherein one of said electrical adapter and said first audio connector of said transmission cable is an audio plug and the other of said electrical adapter and said first audio connector of said transmission cable is an audio jack.

5. The combination hat and earphone assembly as claimed in claim 1, wherein said transmission cable further comprises a volume control for regulating sound level, a mini microphone for converting an external sound wave into an electronic signal and then transmitting the electronic signal through said first audio connector and said electrical adapter to said earphone speakers, and a microphone on/off switch operable to switch on/off said mini microphone.

* * * * *